US007836895B2

(12) United States Patent
Dube et al.

(10) Patent No.: US 7,836,895 B2
(45) Date of Patent: Nov. 23, 2010

(54) FILTERED CIGARETTE INCORPORATING A BREAKABLE CAPSULE

(75) Inventors: Michael Francis Dube, Winston-Salem, NC (US); Kenneth Wayne Smith, Winston-Salem, NC (US); Vernon Brent Barnes, Advance, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 257 days.

(21) Appl. No.: 10/600,712

(22) Filed: Jun. 23, 2003

(65) Prior Publication Data

US 2004/0261807 A1 Dec. 30, 2004

(51) Int. Cl.
*A24D 3/06* (2006.01)
*A24D 3/04* (2006.01)
*B31C 13/00* (2006.01)

(52) U.S. Cl. ..... 131/337; 131/340; 131/346; 493/43

(58) Field of Classification Search ..... 131/337, 131/335, 361, 336, 340, 346
See application file for complete search history.

(56) References Cited

U.S. PATENT DOCUMENTS 1,726,737 A 9/1929 Harris
2,808,057 A 10/1957 Jaksch
2,863,461 A 12/1958 Frost, Jr.
3,066,681 A 12/1962 Cohn
3,270,750 A 9/1966 Campell
3,279,476 A 10/1966 Noznick et al.
3,288,145 A 11/1966 Rosenthal
3,297,038 A * 1/1967 Homburger ..... 131/337
3,334,636 A 8/1967 Zuber
3,339,557 A 9/1967 Karalus
3,339,558 A 9/1967 Waterbury
3,366,121 A 1/1968 Carty
3,390,686 A 7/1968 Irby, Jr. et al.
3,420,242 A 1/1969 Boukair
3,428,049 A * 2/1969 Leake et al. ..... 131/337
3,508,558 A 4/1970 Seyburn
3,513,859 A 5/1970 Carty
3,515,146 A 6/1970 Nealis
3,525,582 A 8/1970 Waterbury (Continued)

FOREIGN PATENT DOCUMENTS

DE 1692936 1/1972

(Continued)

*Primary Examiner*—Philip C Tucker
*Assistant Examiner*—Michael J Felton
(74) *Attorney, Agent, or Firm*—Womble Carlyle Sandridge & Rice, PLLC

(57) ABSTRACT

A filtered cigarette possesses at least one breakable capsule in its filter element. The filter element can possess a central cavity extending from the cigarette tobacco rod towards the middle of the filter element. The central cavity may be defined by an inner filter portion. The inner filter portion can be surrounded by an outer filter portion comprised of filter tow material that is generally permeable to the smoke generated by the cigarette. At least one breakable capsule is disposed in the central cavity of the filter element. The breakable capsules are spherical in shape, and are composed of a gelatin outer shell that encloses a payload of triglycerides and flavoring agents. The breakable capsules are adapted to rupture in response to pressure applied by the smoker to the outside region of the filter element.

34 Claims, 6 Drawing Sheets

U.S. PATENT DOCUMENTS 3,533,416 A * 10/1970 Brooks et al. ..... 131/342
3,547,130 A 12/1970 Harlow et al.
3,552,400 A * 1/1971 Berger et al. ..... 131/339
3,575,180 A 4/1971 Carty
3,596,665 A 8/1971 Lindgard
3,599,646 A * 8/1971 Berger et al. ..... 131/340
3,602,231 A 8/1971 Dock
3,602,235 A 8/1971 Dock
3,625,228 A * 12/1971 Dock ..... 131/337
3,635,226 A 1/1972 Horsewell et al.
3,669,128 A 6/1972 Cohen
3,683,936 A 8/1972 O'Neil, Jr.
3,685,521 A 8/1972 Dock
3,797,644 A 3/1974 Shaw
3,916,914 A 11/1975 Brooks et al.
3,972,335 A 8/1976 Tiggelbeck et al.
3,991,773 A 11/1976 Walker
3,994,306 A * 11/1976 Berger ..... 131/340
4,003,387 A 1/1977 Goldstein
4,046,063 A * 9/1977 Berger ..... 493/43
4,046,153 A 9/1977 Kaye
4,064,791 A 12/1977 Berger
4,075,936 A 2/1978 Berger
4,082,098 A 4/1978 Owens, Jr.
4,126,141 A 11/1978 Grossman
4,311,720 A * 1/1982 Marmo et al. ..... 426/594
4,357,950 A 11/1982 Berger
4,508,525 A 4/1985 Berger
4,677,995 A 7/1987 Kallianos et al.
4,729,391 A 3/1988 Woods et al.
4,848,375 A 7/1989 Patron et al.
4,862,905 A 9/1989 Green, Jr. et al.
4,865,056 A 9/1989 Tamaoki et al.
4,881,555 A 11/1989 Bolt et al.
4,889,144 A 12/1989 Tateno et al.
4,920,990 A 5/1990 Lawrence et al.
4,941,486 A 7/1990 Dube et al.
5,012,829 A 5/1991 Thesing et al.
5,025,814 A 6/1991 Raker
5,067,500 A 11/1991 Keritsis
5,074,320 A 12/1991 Jones, Jr. et al.
5,105,838 A 4/1992 White et al.
5,186,185 A 2/1993 Mashiko et al.
5,271,419 A 12/1993 Arzonico et al.
5,331,981 A 7/1994 Tamaoki et al.
5,360,023 A 11/1994 Blakley et al.
5,365,951 A * 11/1994 Arterbery et al. ..... 131/339
5,396,909 A 3/1995 Gentry et al.
5,549,124 A * 8/1996 Dorsey ..... 131/337
5,718,250 A 2/1998 Banerjee et al.
5,724,997 A 3/1998 Smith et al.
6,041,790 A * 3/2000 Smith et al. ..... 131/360
6,417,156 B1 7/2002 Smith et al.
6,631,722 B2 * 10/2003 Warren et al. ..... 131/331
2002/0020420 A1 2/2002 Xue et al.
2002/0166563 A1 11/2002 Jupe et al.
2003/0098033 A1 5/2003 Macadam et al.
2004/0250822 A1 12/2004 Goshbruche
2004/0250824 A1 12/2004 Goshbruche

FOREIGN PATENT DOCUMENTS

DE 22 28 457 10/1978
JP 2000-014377 D1 1/2000
KR 1999-31274 5/1999
KR 2000-52283 5/1999
KR 20000022596 A 5/2000
WO WO 86/04488 8/1986
WO WO 02/03819 1/2002
WO WO 03/009711 * 2/2003
WO WO 03/039276 5/2003

* cited by examiner

FILTERED CIGARETTE INCORPORATING A BREAKABLE CAPSULE

FIELD OF THE INVENTION

The present invention relates to smoking articles, and in particular, to smoking articles having the form of filtered cigarettes.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The sensory attributes of cigarette smoke can be enhanced by applying additives to tobacco and/or by otherwise incorporating flavoring materials into various components of a cigarette. See, Leffingwell et al., *Tobacco Flavoring for Smoking Products*, R.J. Reynolds Tobacco Company (1972). For example, one type of tobacco flavoring additive is menthol. See, Borschke, *Rec. Adv. Tob. Sci.,* 19, p. 47-70, 1993. Various proposed methods for modifying the sensory attributes of cigarettes have involved suggestion that filter elements may be used as vehicles for adding flavor to the mainstream smoke of those cigarettes. U.S. patent application Ser. No. 2002/0166563 to Jupe et al. proposes the placement of adsorbent and flavor-releasing materials in a cigarette filter. U.S. patent application Ser. No. 2002/0020420 to Xue et al. proposes the placement of fibers containing small particle size adsorbents/absorbents in the filter. U.S. Pat. Nos. 4,941,486 to Dube et al. and 4,862,905 to Green, Jr. et al. propose the placement of a flavor-containing pellet in a cigarette filter. Other representative types of cigarette filters incorporating flavoring agents are set forth in U.S. Pat. Nos. 3,972,335 to Tiggelbeck et al.; 4,082,098 to Owens, Jr.; 4,729,391 to Woods et al.; and 5,012,829 to Thesing et al.

Cigarettes having adjustable filter elements that allow smokers to select the level of flavor that is available for transfer into mainstream smoke have been proposed. See, for example, U.S. Pat. Nos. 4,677,995 to Kallianos et al. and 4,848,375 to Patron et al. Some proposed cigarettes may be manipulated, reportedly for the purpose of providing components of their filter elements with the propensity to modify the nature or character of mainstream smoke. See, for example, U.S. Pat. Nos. 3,297,038 to Homburger; 3,339,557 to Karalus; 3,420,242 to Boukar; 3,508,558 to Seyburn; 3,513,859 to Carty; 3,596,665 to Kindgard; 3,669,128 to Cohen; and 4,126,141 to Grossman. Some proposed cigarettes have capsules positioned in their filter elements, and the contents of those capsules reportedly are released into the filter elements upon rupture of those capsules in the attempt to alter the nature or character of the mainstream smoke passing through those filter elements. See, for example, U.S. Pat. Nos. 3,339,558 to Waterbury; 3,366,121 to Carty; 3,390,686 to Irby, Jr. et al.; 3,428,049 to Leake; 3,547,130 to Harlow et al; 3,575,1809 to Carty; 3,602,231 to Dock; 3,625,228 to Dock; 3,635,226 to Horsewell et al.; 3,685,521 to Dock; 3,916,914 to Brooks et al.; 3,991,773 to Walker; and 4,889,144 to Tateno et al. PCT WO 03/009711 to Kim proposes a filtered cigarette having at least one capsule containing aromatic material disposed in the filter section of that cigarette; and the application of pressure to the capsule reportedly causes the capsule to burst and discharge aromatic material into the filter so as to change the taste of the tobacco experienced during the course of smoking. Some proposed cigarettes have capsules positioned in their filter elements, and the contents of those capsules reportedly are released into the filter elements upon rupture of those capsules in order to deodorize the filter element after the cigarette is extinguished. See, for example, U.S. Pat. Appl. No. 2003/0098033 to MacAdam et al.

Commercially marketed "Rivage" brand cigarettes have included a filter possessing a cylindrical plastic container containing water or a liquid flavor solution. Cigarettes representative of the "Rivage" brand cigarettes are described in U.S. Pat. Nos. 4,865,056 to Tamaoki et al. and 5,331,981 to Tamaoki et al., both of which are assigned to Japan Tobacco, Inc. The cylindrical casing within the filter reportedly may be deformed upon the application of external force, and a thin wall portion of the casing is consequently broken so as to permit release of the liquid within the casing into an adjacent portion of that filter.

A cigarette holder has been available under the brand name "Aquafilter." Cigarette holders representative of the "Aquafilter" brand product are described in U.S. Pat. Nos. 3,797,644 to Shaw; 4,003,387 to Goldstein; and 4,046,153 to Kaye; assigned to Aquafilter Corporation. Those patents propose a disposable cigarette holder into which the mouth end of a cigarette is inserted. Smoke from the cigarette that is drawn through the holder reportedly passes through filter material impregnated with water. A disposable filter adapted to be attachable to the mouth end of a cigarette has been proposed in U.S. Pat. No. 5,724,997 to Smith et al. Flavor containing capsules contained within the disposable filter reportedly may be squeezed in order to release the flavor within those capsules.

Cigarettes incorporating distinctive flavors that provide a pleasurable sensory experience are clearly of interest to smokers. Some smokers may prefer a cigarette that is capable of selectively providing a variety of different flavors, depending upon the smoker's immediate desire. The flavor of such a cigarette might be selected based on the smoker's desire for a particular flavor at that time, or a desire to change flavors during the smoking experience. For example, changing flavors during the smoking experience may enable a smoker to end the cigarette with a breath freshening flavor, such as menthol or spearmint. Accordingly, it is desirable to provide a cigarette that is capable of providing different sensory experiences at the discretion of a smoker.

Some smokers may also desire a cigarette that is capable of selectively releasing a deodorizing agent upon completion of a smoking experience. Such agents may be used to ensure that the remaining portion of a smoked cigarette yields a pleasant aroma after the smoker has finished smoking that cigarette.

Accordingly, it is desirable to provide a cigarette that is capable of releasing a deodorizing agent, particularly at the discretion of the smoker.

Some smokers may desire a cigarette that is capable of selectively moistening, cooling, or otherwise modifying the nature or character of the mainstream smoke generated by that cigarette. Because certain agents that can be used to interact with smoke are volatile and have the propensity to evaporate over time, the effects of those agents upon the behavior of those cigarettes may require introduction of those agents near commencement of the smoking experience. Accordingly, is desirable to provide a cigarette that is capable of selectively moistening, smoothing or cooling the smoke delivered to a smoker at the discretion of that smoker.

It would be highly desirable to provide smokers with the ability to enhance their smoking experience. That is, it would be desirable to provide a cigarette that can selectively provide a manner or method for altering, in a controlled way, the nature or character of the mainstream smoke produced by that cigarette. In particular, it would be desirable to provide a cigarette that is capable of releasing an agent for enhancing the sensory attributes of the mainstream smoke (e.g., by flavoring that smoke).

SUMMARY OF THE INVENTION

The present invention relates to filtered smoking articles, such as cigarettes possessing filter elements. A representative filtered smoking article includes at least one breakable capsule incorporated into its filter element. The breakable capsules can be adapted to rupture in response to pressure applied by the smoker to the outside of the filter element. Such a smoking article can be smoked without breaking the capsule contained within its filter element, or the capsule may be broken before, during, or even after, the use of the smoking article.

In one aspect, the filter element incorporates at least one rupturable capsule that possesses (i) an outer shell composed of a material such as gelatin, and (ii) an inner region sealed by the outer shell and composed of a compound that is intended to introduce some change to the nature or character of mainstream smoke drawn through that filter element (e.g., a flavoring agent). Most preferably, the inner region of the capsule also incorporates a suitable liquid carrier for that flavoring agent, and a representative liquid carrier is provided by a mixture of triglycerides. Preferably the contents of the inner region of the capsule are essentially non-aqueous in nature.

In another aspect, the present invention relates to a filtered smoking article having a filter element that possesses a hollow region or cavity into which at least one rupturable capsule is positioned. A preferred filtered smoking article is a filtered cigarette having a tobacco rod and a filter element positioned at one end thereof.

In one embodiment, the filtered cigarette possesses a filter element comprising a cavity that extends from the end of that filter element adjacent the tobacco rod and towards the middle region of that filter element. Preferably, the general shape of the cavity is defined by an inner filter portion comprised of material that possesses the ability to generally maintain its shape, and hence is capable of receiving and maintaining at least one breakable capsule in a desired location or position; and the inner filter portion is surrounded by an outer filter portion comprised of filter material that allows for passage of mainstream smoke that is drawn through the filter element from the burning tobacco rod. The positioning of the filter element relative to the tobacco rod ensures that the capsule is maintained in the desired location within the smoking article.

In another embodiment, the filtered cigarette possesses a filter element comprising at least two longitudinally positioned segments, and one of those segments possesses a cavity into which at least one rupturable capsule is positioned. The cavity can extend from the end of the filter segment opposite the tobacco rod and towards the middle region of that filter element; that is, the cavity does not extend entirely through the length of that filter segment. The general shape of that cavity can be defined by an inner filter portion comprised of material that possesses the ability to generally maintain its shape, and hence is capable of receiving and maintaining in position at least one breakable capsule; and the inner filter portion is surrounded by an outer filter portion comprised of filter material that allows for passage of mainstream smoke that is drawn through the filter element from the burning tobacco rod. Alternatively, the general shape of the cavity can be defined by the hollow inner region of a generally tubular shaped filter segment; that is, the cavity portion of the filter segment extends entirely through the length of that filter segment. Such a tubular shaped segment possesses the ability to receive and maintain in position at least one breakable capsule; and also allows for passage of mainstream smoke that is drawn through the filter element from the burning tobacco rod. In either case, the positioning of a second filter segment relative to the cavity end of the first filter segment containing the capsule ensures that the capsule is maintained in the desired location within the smoking article.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of embodiments of the invention, reference will now be made to the appended drawings, in which like reference numerals refer to like elements. The drawings are exemplary only, and should not be construed as limiting the invention.

DETAILED DESCRIPTION OF THE PREFERRED EMBODIMENTS

Figure 1:
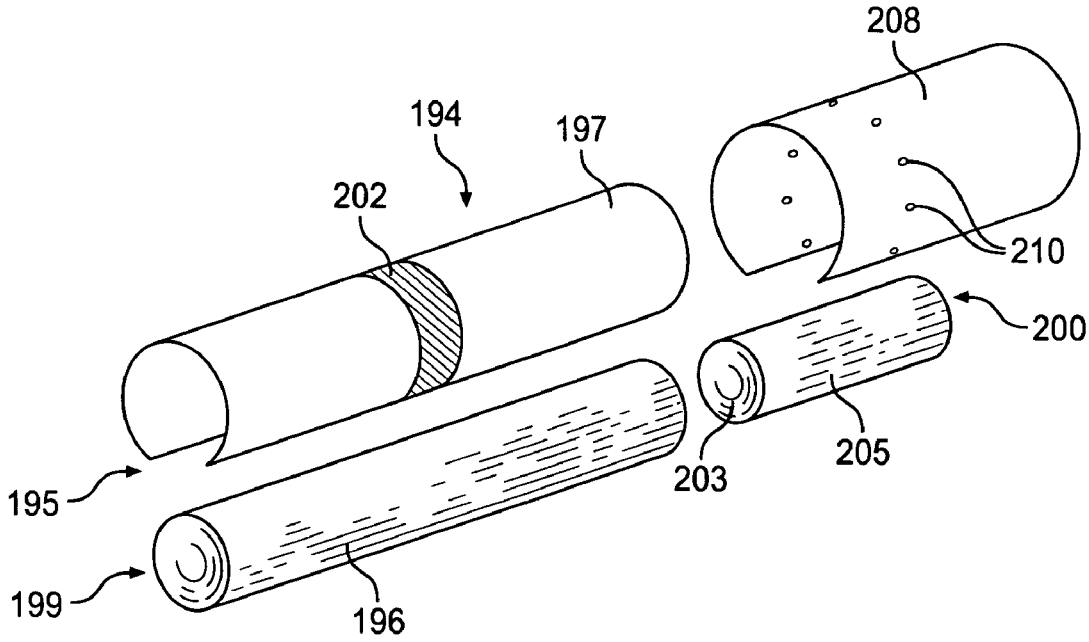
FIG. 1 is an exploded perspective view of a smoking article having the form of a cigarette, showing the smokable material, the wrapping material components, and the filter element of that cigarette.

Referring to FIG. 1, a smoking article 194 possessing certain representative components of a smoking article of the present invention is shown. The cigarette 194 includes a generally cylindrical rod 195 of a charge or roll of smokable filler material 196 contained in a circumscribing wrapping material 197. The rod 195 is conventionally referred to as a "tobacco rod." The ends of the tobacco rod are open to expose the smokable filler material. At one end of the tobacco rod 195 is the lighting end 199, and at the other end is positioned a filter element 200. The cigarette 194 is shown as having one optional printed band 202 on printed wrapping material 197, and that band circumscribes the cigarette rod in a direction transverse to the longitudinal axis of the cigarette. That is, the band provides a cross-directional region relative to the longitudinal axis of the cigarette. The band can be printed on the inner surface of the wrapping material (i.e., facing the smokable filler material) or on the outer surface of the wrapping material. Although the cigarette can possess a wrapping material having one optional band, the cigarette also can possess wrapping material having further optional spaced bands numbering two, three, or more.

The wrapping material of the tobacco rod 197 can have a wide range of compositions and properties. The selection of a particular wrapping material will be readily apparent to those skilled in the art of cigarette design and manufacture. Tobacco rods can have one layer of wrapping material; or tobacco rods can have more than one layer of circumscribing wrapping material, such as is the case for the so-called "double wrap" tobacco rods. Exemplary types of wrapping materials, wrapping material components and treated wrapping materials are described in U.S. Pat. No. 5,220,930 to Gentry; and U.S. patent application Ser. Nos. 10/303,648, filed Nov. 25, 2002, 10/324,418, filed Dec. 20, 2002 and 10/440,290, filed May 16, 2003; which are incorporated herein by reference in their entireties.

The cigarette 194 includes a filter element 200 positioned adjacent one end of the tobacco rod 195 such that the filter element and tobacco rod are axially aligned in an end-to-end relationship, preferably abutting one another. Filter element 200 may have a generally cylindrical shape, and the diameter thereof may be essentially equal to the diameter of the tobacco rod. The ends of the filter element permit the passage of air and smoke therethrough. The filter element 200 includes filter material 203 (e.g., plasticized cellulose acetate tow) that is over-wrapped along the longitudinally extending surface thereof with circumscribing plug wrap material 205. The filter element 200 possesses a cavity (not shown) into which at least one capsule (not shown) is positioned. The filter element 200 can have two or more filter segments (not shown), and/or flavor additives incorporated therein. Further details regarding the filter element itself, segments thereof (not shown), the production and shape of a cavity (not shown) therein, and capsules (not shown) that are positioned within the cavity, are provided hereinafter.

The filter element 200 can be attached to the tobacco rod 195 by tipping material 208, which circumscribes both the entire length of the filter element and an adjacent region of the tobacco rod 195. The inner surface of the tipping material 208 is fixedly secured to the outer surface of the plug wrap 205 and the outer surface of the wrapping material 197 of the tobacco rod, using a suitable adhesive; and hence, the filter element and the tobacco rod are connected to one another. A ventilated or air diluted smoking article can be provided with an optional air dilution means, such as a series of perforations 210, each of which extend through the tipping material and plug wrap (e.g., pre-perforated tipping material and porous plug wrap can be employed, or the filter element can be provided with a circumscribing ring of laser perforations).

The tobacco rod 195, the filter element 200 and the cigarette 194 resulting from the combination thereof can be manufactured using various types of conventional cigarette and cigarette component manufacturing techniques and equipment, without extensive modification to certain of those conventional techniques and equipment. See, for example, the types of cigarette making equipment set forth in U.S. patent application Ser. Nos. 10/324,836, filed Dec. 20, 2002 and 10/440,290, filed May 16, 2003. Certain of the manners and methods suitable for the commercial production of cigarettes of the present invention using the tobacco rods, filter elements, and other components described herein will be readily apparent to those skilled in the art of cigarette manufacture.

Tobacco materials useful for carrying out the present invention can vary. Tobacco materials can be derived from various types of tobacco, such as flue-cured tobacco, burley tobacco, Oriental tobacco or Maryland tobacco, dark tobacco, dark-fired tobacco and *Rustica tobaccos*, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). Most preferably, the tobaccos are those that have been appropriately cured and aged.

Typically, tobacco materials for cigarette manufacture are used in a so-called "blended" form. For example, certain popular tobacco blends, commonly referred to as "American blends," comprise mixtures of flue-cured tobacco, burley tobacco and Oriental tobacco. Such blends, in many cases, contain tobacco materials that have a processed form, such as processed tobacco stems (e.g., cut-rolled or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes*, 3rd Ed., p. 43 (1990) and *Tobacco Production, Chemistry and Technology*, Davis et al. (Eds.) p. 346 (1999).

Other representative tobacco types and types of tobacco blends also are set forth in U.S. Pat. Nos. 4,836,224 to Lawson et al.; 4,924,888 to Perfetti et al.; 5,056,537 to Brown et al.; 5,220,930 to Gentry; and 5,360,023 to Blakley et al.; U.S. Pat. Appl. No. 2002/0000235 to Shafer et al.; PCT WO 02/37990; U.S. patent application Ser. No. 10/285,395, filed Oct. 31, 2002; and Bombick et al., *Fund. Appl. Toxicol.,* 39, p. 11-17 (1997).

Tobacco materials typically are used in forms, and in manners, that are traditional for the manufacture of smoking articles, such as cigarettes. The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within the tobacco rod of a cigarette ranges from about 0.6 g to about 1 g. The tobacco filler normally is employed so as to fill the tobacco rod at a packing density of about 100 mg/cm$^3$ to about 300 mg/cm$^3$, and often about 150 mg/cm$^3$ to about 275 mg/cm$^3$.

If desired, the tobacco materials of the tobacco rod can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

Figure 2:
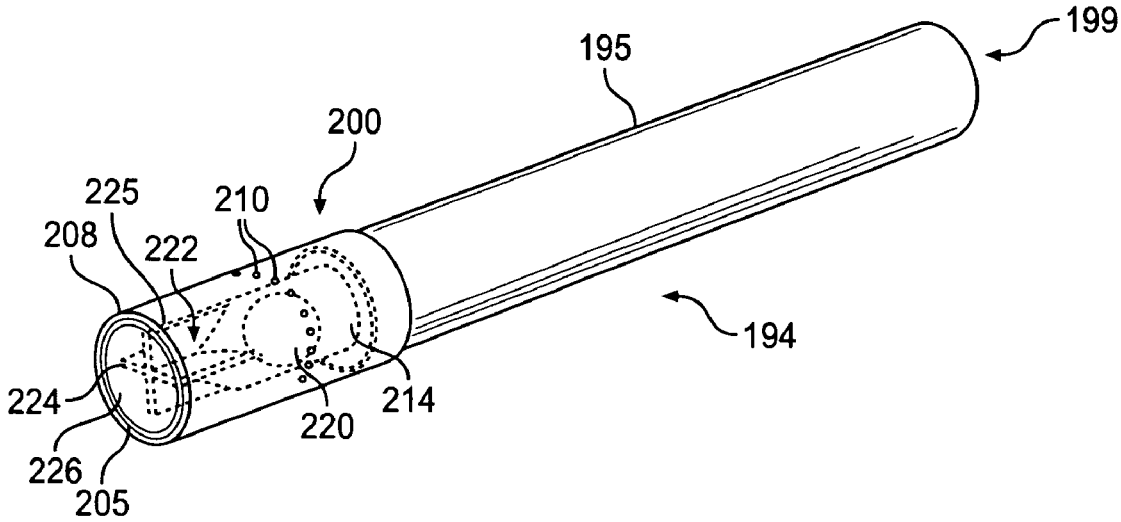
FIG. 2 is a perspective view of the filtered cigarette showing the filter element region in phantom; and showing the filter element as including a breakable capsule positioned within a cavity within that filter element.

Referring to FIG. 2, there is shown one preferred embodiment of a cigarette 194 representative of the present invention. The cigarette 194 possesses a tobacco rod 195 and a filter element 200. The filter element 200 includes a central cavity 214. The central cavity 214 is a hollow region that extends along the longitudinal axis of the filter element for a portion of the length of the filter element. At least one breakable capsule 220 is disposed in the cavity 214, and the open end of the cavity faces one end of the tobacco rod 195. Each breakable capsule 220 most preferably carries a payload incorporating a compound that is intended to introduce some change to the nature or character of mainstream smoke drawn through that filter element (e.g., a flavoring agent). That is, the capsule 220 may be ruptured at the discretion of the smoker to release the capsule payload. The filter element 200 is bound along its outer circumference by a layer of plug wrap 205 (e.g., porous paper plug wrap), and connected to the tobacco rod 195 by tipping material 208 (e.g., essentially air impermeable tipping paper). The filter element 200 and the tobacco rod 195 are aligned in an end-to-end relationship, preferably abutting one another, and hence the capsule 214 within the cavity 220 remains physically lodged in a desired location within the cigarette 194. A plurality of perforations 210 optionally can be provided in the tipping paper 208 and, plug wrap 205, for air dilution purposes.

The overall shape of the central cavity 214 is determined by the construction of the filter element 200. The filter element 200 includes an axially elongated inner portion, element, member or section 222 (shown in phantom) that is crimped into a generally cross-shaped form at the extreme mouthend 224 (i.e., the crimped end 225 is located at the end distal from the tobacco rod 19S). The inner element 222 is open at its other end, and hence defines a cavity 214 that is open at the end proximal to the tobacco rod 195. The inner element 222 is generally conical in shape where it transitions from a crimped cross-shape to that of a generally cylindrical cavity. A representative cavity 214 extends approximately half the overall length of the filter element 220, to the point at which it meets one end portion of the crimped end 225. That is, the cavity is open at one end and closed at the other end, at least relative to allowing for passage of the capsule 220. The axially elongated outer element or section 226, preferably comprised of cellulose acetate tow or other suitable cigarette filter material, surrounds the inner element or section 222. That is the longitudinally extending inner section 222 is circumscribed by, or longitudinally embedded within, the annulus of longitudinally extending outer section 226 that extends entirely around the outer longitudinal periphery of the inner element. As such, the passage or cavity 214 is component fashioned within a filter element segment, rather than a cavity formed by the longitudinal spacing of two cylindrical filter segments (e.g., as is the case for commercially marketed "cavity filters"). As such, the capsule 220 is located within an airspace within a filter element that is open at one end; the capsule is enclosed by filter material at the other longitudinal end of that filter element; and the capsule is enclosed by filter material in the region that surrounds the capsule in a transverse direction relative to the longitudinal axis of the filter element. The longitudinal surface of the outer portion 226 of the filter material of the filter element is in turn bound or circumscribed by plug wrap 205.

The tipping material 208 connecting the filter element 200 to the tobacco rod 195 can have indicia (not shown) printed thereon. For example, a band (not shown) can indicate to a smoker the general location or position of the capsule 220 within the filter element 200. These indicia may help the smoker to locate the capsule 220 so that it can be more easily ruptured by squeezing the filter element 200 directly outside the position of the capsule. The indicia on the tipping material 208 may also indicate the nature of the payload carried by the capsule 220. For example, the indicia may indicate that the particular payload is a spearmint flavoring by having a particular color, shape, or design.

The optional perforations 210 can be made by various techniques known to those of ordinary skill in the art, such as laser perforation techniques. As these techniques are carried out after insertion of a capsule 220 into the filter 200, care is taken to avoid damaging the capsules during the formation of the perforations 210. One way to avoid damage from air dilution techniques, such as those employing laser perforation technologies, involves locating the perforations at a position adjacent to the position of the capsule 220. In such a manner, radiation, heat or physical forces acting upon the filter 200 during perforation processes do not have such a great propensity to damage the capsule. Alternatively, so-called off-line air dilution techniques can be used (e.g., through the use of porous paper plug wrap and pre-perforated tipping paper).

The dimensions of a representative cigarette 194 can vary. Preferred cigarettes are rod shaped, and can have diameters of about 7.5 mm (e.g., circumferences of about 22.5 mm to about 25 mm); and can have total lengths of about 85 mm to about 100 mm. The length of the filter element 200 can vary. Typical filter elements can have lengths of about 20 mm to about 40 mm. In one preferred embodiment, the length of the filter element 200 is about 27 mm and the length of the tobacco rod 195 is about 58 mm. The tipping paper 208 can circumscribe the entire filter element 200 and about 4 mm of the length of the tobacco rod 195 in the region adjacent to the filter element. A representative cavity 214 can extend from one end of the filter element 200 about 13 mm along the length of that filter element. A representative cavity 214 can have a diameter of about 4 mm at the open end of the filter element 200. A capsule 220 can be positioned about 6 mm to about 8 mm from the open end the filter element 200.

In use, the smoker lights the lighting end 199 of the cigarette 194 and draws smoke into his/her mouth through the filter element 200 at the opposite end 224 of the cigarette. The smoker can smoke all or a portion of the cigarette 194 with the capsule 220 intact. During the portion of the smoking experience that the capsule 220 remains intact, smoke generated in the tobacco rod 195 is drawn principally through the filter material 226 located in the outer peripheral region of the filter element 200 to the smoker. Most preferably, the overall character or nature of the drawn smoke is virtually unaffected to any significant degree as a result of the presence of the intact capsule 220 within the filter element 200. If desired, the smoker may rupture the capsule 220 at any time before, during, or even after, the smoking experience. Breakage of the capsule 220 acts to release the contents that are contained and sealed therewithin. Release of the contents of the capsule into the filter element thus enables the smoker to achieve the intended benefit of action of certain of those contents, whether that benefit results from flavoring or scenting the smoke, cooling or moistening the smoke, freshening the scent of the cigarette butt, or achieving some other goal associated with modifying the overall composition of the smoke or altering the performance characteristics of the cigarette. That is, in highly preferred embodiments, a portion of the payload (e.g., portions of a flavoring agent) that has been released into the filter element is incorporated into each subsequent puff of mainstream smoke that is received through that filter element.

Preferred cigarettes of the present invention exhibit desirable resistance to draw, whether or not the capsules within their filter elements are broken. For example, an exemplary cigarette exhibits a pressure drop of between about 50 and about 200 mm water pressure drop at 17.5 cc/sec. air flow. Preferred cigarettes exhibit pressure drop values of between about 70 mm and about 180, more preferably between about 80 mm to about 150 mm, water pressure drop at 17.5 cc/sec. air flow. Typically, pressure drop values of cigarettes are measured using a Filtrona Filter Test Station (CTS Series) available form Filtrona Instruments and Automation Ltd.

Application of physical pressure to the capsule 220, for example by a squeezing action provided by the fingers of the smoker to the filter element 200, causes relevant regions of the filter element to deform and hence causes the capsule to rupture and release its payload to the cavity interior 214 of the filter element. The rupture of the capsule 220 can be discerned by an audible pop, snap, or a rapid decrease in the resistance to the pressure applied by the smoker. Rupture of the capsule 220 causes contents of its payload to disperse throughout the cavity 214, throughout the filter tow material in the outer element 226, and potentially to some extent into the tobacco rod 195. Most preferably, the overall cylindrical shape of the filter element returns to essentially its original shape after the application of pressure to the filter element is ceased.

Figure 3:
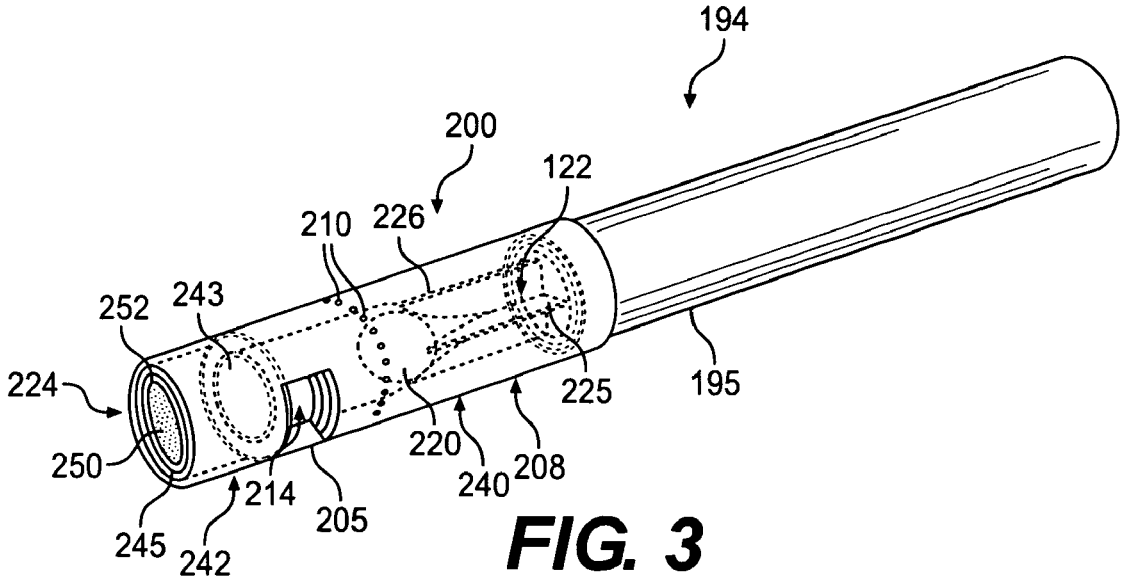
FIG. 3 is a perspective view of the filtered cigarette showing the filter element region in phantom; and showing the filter element as including a breakable capsule positioned within a cavity within one segment of that filter element.

Referring to FIG. 3, there is shown an alternate embodiment of a cigarette 194 representative of the present invention. The cigarette possesses a tobacco rod 195 having a filter element 200 connected at an end thereof using tipping material 208. The filter element 200 is composed of two longitudinally aligned segments 240, 242. Each of those segments 240, 242 is maintained in place relative to one another using plug wrap 245 that circumscribes the outer longitudinally extending surfaces of both of those filter segments. The first segment 240 is positioned adjacent one end of the tobacco rod 195, preferably in an abutting end-to-end relationship. The second segment 242 is positioned adjacent the first segment 240, preferably in an abutting end-to-end relationship, at the extreme mouthend 224 of the cigarette.

The first segment 240 possesses a longitudinally extending inner section 222 that is circumscribed by, or longitudinally embedded within, the annulus of longitudinally extending outer section 226 that extends entirely around the outer longitudinal periphery of the inner element. The longitudinal surface of the outer element 226 is in turn bound or circumscribed by plug wrap 205. The first segment possesses a central cavity 214, and at least one capsule 220 is positioned within that cavity. The type of filter element previously described with reference to FIG. 2 can be used to provide the first filter segment 240, except that the orientation of the cavity 214 is such that the open end 243 of the cavity is located at the end of the cigarette distal from the tobacco rod, and the crimped end 225 of the filter segment is proximal to the tobacco rod 195.

The second segment 242 most preferably is a generally cylindrically shaped filter segment. The second segment most preferably is manufactured from a traditional cigarette filter material 250, such as cellulose acetate tow, gathered cellulose acetate web, polypropylene tow, gathered cellulose acetate web, gathered paper, strands of reconstituted tobacco, or the like. Typically, the filter material 250 of second filter segment 242 is circumscribed by a layer of plug wrap 252. For exemplary cigarette filter segments for multi-component cigarette filters, see, for example, U.S. Pat. Nos. 4,920,990 to Lawrence et al.; 5,012,829 to Thesing et al.; 5,025,814 to Raker; 5,074,320 to Jones et al.; 5,105,838 to White et al.; 5,271,419 to Arzonico et al.; and 5,360,023 to Blakley et al.; which are incorporated herein by reference. The second filter segment 242 is positioned adjacent to the first filter segment 240 so that the second filter segment covers the open end of the cavity 214, in order to prevent passage of the capsule 220 from the cavity 214. The second filter segment 242 essentially conceals the cavity 214, so that the outward appearance of the overall filter element 200 is generally similar to that of traditional filter elements that do not include such a cavity. The orientation of the cavity 214 towards the mouth of the smoker also provides the ability to deliver a relatively high yield of the capsule payload to the smoker, because the capsule payload released upon rupture of the capsule need only pass through the relatively short second filter segment 242 to reach the smoker. The second filter element 242 can be provided with various degrees of permeability to facilitate the passage of the capsule payload to the smoker.

For a typical dual segment filter element 200, the first filter segment 240 possessing the capsule-filled cavity typically has a length of about 15 mm to about 30 mm; and the second filter segment 242 has a length of about 5 mm to about 10 mm, most preferably about 10 mm. Preferred dual segment filter elements 200 have overall lengths of about 25 mm to about 35 mm.

Figure 4:
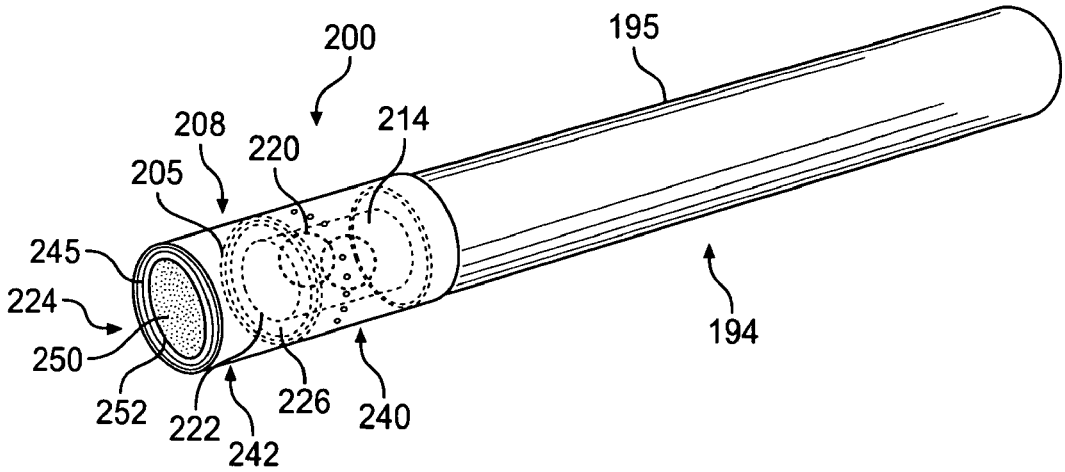
FIG. 4 is a perspective view of the filtered cigarette showing the filter element region in phantom; and showing the filter element as including a breakable capsule positioned within a cavity within one segment of that filter element.

Referring to FIG. 4, there is shown yet another alternate embodiment of a cigarette representative of the present invention. The cigarette possesses a tobacco rod 195 having a filter element 200 connected at an end thereof using tipping material 208. The filter element 200 is composed of two longitudinally aligned segments 240, 242. Each of those segments 240, 242 are maintained in place relative to one another using plug wrap 245 that circumscribes the outer longitudinally extending surfaces of both of those filter segments. The first segment 240 is positioned adjacent one end of the tobacco rod 195, preferably in an abutting end-to-end relationship. The second segment 242 is positioned adjacent the first segment 240, preferably in an abutting end-to-end relationship, at the extreme mouthend 224 of the cigarette.

A cigarette having a general configuration of the type shown in FIG. 4 can be provided by incorporating a breakable capsule in a cavity or passageway region of a generally tubular filter segment, such as for example, the type of filter segment that is described in connection with the types of filter elements set forth in U.S. Pat. No. 4,920,990 to Lawrence et al., which is hereby incorporated by reference in its entirety. Alternatively, a cigarette having a general configuration of the type shown can be provided by suitably incorporating a second filter segment at the extreme mouthend of the type of cigarette described previously with reference to FIG. 2; that is, a segment having an inner portion 222 circumscribed longitudinally by an outer portion 226. Details relating to the composition of the second segment 242, and the construction of the cigarette using two filter segments, are set forth previously with reference to FIG. 3.

For the embodiment shown in FIG. 4, the first filter segment 240 is cylindrical along its entire length, and does not include a conical portion. The central cavity 214 in the first filter segment 240 can have an opening at the end proximal to the tobacco rod 195 that communicates directly with the tobacco rod. In an alternative embodiment (not shown), the central cavity 214 does not extend across the full length of the first filter segment 240. The filter material 226 of the first segment 240 may be absent of plug wrap (i.e., the tubular cylinder can be provided from a segment of a non-wrapped acetate type of processed cellulose acetate tow), or that segment can possess a circumscribing layer of plug wrap 205. The cavity 214 within the first filter segment 240 contains at least one capsule 220. The second filter segment 242 is composed of cigarette filter material 250 circumscribed by plug wrap 252; and essentially conceals the cavity 214 (and other features that are distinctive of the mouthend of the first filter segment 240), so that the outward appearance of the overall filter element 200 is similar to that of traditional filter elements that do not include such a cavity.

Other types of cigarettes possessing multi-component filters also can incorporate those types of capsule-containing filter segments representative the present invention. For example, capsule-containing filter segments of the present invention can be incorporated into the multi-component filter of cigarettes of the type set forth in U.S. Pat. Nos. 5,360,023 to Blakley; 5,396,909 to Gentry et al.; and 5,718,250 to Banerjee et al; U.S. Pat. Appl. No. 2002/0166563 to Jupe et al.; and PCT WO 03/047836 to Xue et al.

For cigarettes of the present invention, the portion of the filter element that possesses the cavity into which the capsule or capsules are placed and maintained is such that the cavity effectively maintains its overall shape during the manufacture, storage and use of the cigarette. For example, for a preferred embodiment of the present invention, the ends of the inner region, portion or member of a filter element manufactured from filter element components arranged in a generally concentric manner can be generally described as providing a structure of cavity walls that can be somewhat rigid or resilient in nature. Overall, the filter element possesses sufficient flexibility to allow squeezing pressure applied by the fingers of the smoker to break the capsule, and to allow the deformed filter element to return to its original shape. The inner region of such a concentric type of filter element can be constructed from a variety of materials, including, for example, cellulose acetate tow impregnated with triacetin plasticizer. The cellulose acetate tow and triacetin most preferably are steam bonded and shaped to the desired configuration. That is, the filter material of the inner element is processed so as to provide a hollow region or cavity that has a defined shape that is retained to an overall degree during normal conditions of manufacture, storage and use of the cigarette. The size and shape of the cavity may be such that the capsule can supported in the desired location as a result of a type of friction fit. The triacetin plasticizer, or other components of the filter, may make the walls of the cavity formed by the inner element tacky, thereby facilitating the retention of a capsule in the cavity. Alternative materials and methods may be employed to construct the inner element, and the inner element may be permeable or virtually impermeable to drawn mainstream smoke. Although the crimped end of a typical inner element is preferably formed into a cross type of shape, the crimped end of the inner element may be gathered or formed into alternative shapes. For example, one end of the inner element may be crimped into a wedge shape, which also can aid in retaining a capsule within the cavity.

Preferably, a representative filter element possessing a central cavity having a generally circular cross-sectional shape has a diameter of about 3 mm to about 4 mm at its widest point. However, the walls of the cavity may be defined by compressible and deformable material (e.g., plasticized cellulose acetate), and the cavity may be manufactured so as to have a greater or smaller diameter. Accordingly, the cavity may accept one or more capsules having diameters of at least about 1 mm, typically at least about 2 mm, and often at least about 3 mm. Typically, the capsules have diameters that do not exceed about 6 mm, often do not exceed about 5 mm, and frequently do not exceed about 4.5 mm. Certain preferred capsules have diameters in the range of about 3 mm to about 4 mm in diameter, and certain highly preferred capsules are approximately 3.5 mm in diameter. For a cigarette having a diameter of about 7 mm to about 8 mm, a typical cavity having a diameter of about 4 mm can readily accept and maintain in the desired position within the filter element a capsule having a diameter of about 3.5 mm.

The general shape of the central cavity can vary. One type of cavity has a generally cylindrical shape and terminates at one end in the point of a cone. That is, the inner portion of a representative filter segment defines a central cavity having a generally conically shaped end and a cylindrically shaped portion. The cavity can possess various favorable properties for the insertion, placement, retention, protection and/or rupture of the capsule inserted therein. The interior surface of the inner portion of the filter segment can possess a roughened, adhesive, tacky, other particular surface suitable for the retention of a capsule at a fixed position within the cavity. For example, the cavity wall can possess a coating of triacetin plasticizers capable of causing some adhesion with the capsule.

The manner of inserting the capsule into the cavity can vary. The capsule can be dropped into the cavity, inserted or pushed into the cavity using a plunger-type of device, injected into the cavity as assisted by the flow of air, or other suitable method.

Retention of the capsule in a fixed position in the cavity within the filter element may also be aided by the crimped end of the cavity. The crimped end provides a conical terminus with an inclined surface against which the capsule may be wedged. Thus, the capsule may be inserted into the cavity using a force pre-selected to cause the capsule to lodge against the conical terminus, but not sufficiently great to cause premature rupture of the capsule. Wedging the capsule against the conical terminus allows each capsule to be lodged or secured in place until being ruptured by a smoker. Retention of the capsule in a fixed position reduces the likelihood that the capsule will be prematurely ruptured due to the types of forces and stresses experienced during normal manufacturing, packaging, shipping and handling operations. In addition, it is desirable to achieve consistent placement of the capsule within the cavity. As a result, a smoker readily can locate the capsule within the filter element.

Upon rupture of the capsule during use of the cigarette, dispersion of the payload of the capsule may be aided by the conical portion of the central cavity. Rupture pressure applied to the capsule by contact with the inclined wall of the conical portion can cause the capsule to rupture at a point generally opposite to the terminus of the conical portion. In turn, this rupture point may cause the burst of payload emitted from the capsule to be directed away from the conical terminus and either toward the tobacco in the tobacco rod and the surrounding tow when the filter element is arranged as shown in FIG. 2; or into the tow material near the smoker's mouth when the filter element is arranged as shown in FIG. 3.

Most preferably, the flexible, yet resilient filter element is suited to aid in rupturing the capsule without compromising its ability to rebound to its initial cylindrical form. In addition, the conical portion of the central cavity can in some instances provide a suitable surface for applying rupture pressure to the capsule. The point at which the conical portion of the central cavity meets the crimped end may be somewhat hard in the transition region between the conical portion and the crimped end. This hardened transition region can be useful for applying pressure to the capsule from the outside of the filter element.

In contrast to a typical inner portion of a representative filter element, the outer portion most preferably is constructed of material and in a manner such that the outer portion is generally permeable to drawn mainstream smoke. The outer portion can be constructed of a material suitable for use as a cigarette filter material, such as a suitable tow material. For example, the filter material can be provided by suitably plasticized cellulose acetate tow, polypropylene tow, or the like. Other suitable materials for construction of the outer portion of the filter element will be readily apparent to those skilled in the art of cigarette filter design and manufacture. Additional information regarding methods and apparatus for manufacturing the representative types of suitable filter elements are set forth in U.S. Pat. Nos. 4,046,063 to Berger; 4,064,791 to Berger; 4,075,936 to Berger; 4,357,950 to Berger; and 4,508,525 to Berger, which are incorporated herein by reference.

The materials used to construct the inner and outer filter portions of a filter element having a concentric configuration can aid in the dispersion and delivery of the capsule payload to the smoker. In one aspect, both the inner and outer portions of the filter element are constructed of cellulose acetate tow materials (or other suitable filter materials), that typically are processed in different manners. At least one of those portions is constructed from a filter material (e.g., cellulose acetate tow) that is processed in such a manner so as to be generally absorbent of liquids, and hence capable of wicking the liquid payload components released from the capsule into the tow material for delivery to the smoker (or otherwise allowing for movement or transfer of the released capsule components throughout filter element).

Figure 5:
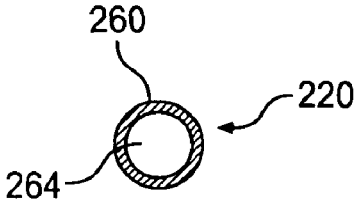
FIG. 5 is a cross-sectional view of a representative spherical breakable capsule.

Referring to FIG. 5, a representative capsule 220 is generally spherical in shape. Such a capsule possesses an outer shell 260 that surrounds an internal payload 264. The outer shell 260 most preferably encloses the payload 264 in such a manner that the payload is tightly sealed. The shape of the capsule can vary, but the capsule most preferably is spherical. Most preferably, the capsules have high degrees of roundness, and possess consistent physical specifications (e.g., consistent dimensions, consistent weights and consistent formulations) in order to enhance the ability to manufacture cigarettes incorporating those capsules using automated machinery, and in order to produce cigarettes of consistent quality. Suitable capsules are commercially available from Mane Aromatic Flavors, located in Nice, France as gelatin encapsulated mixtures of medium chain triglycerides and flavor agents. The designations of a number of flavor capsules that are available from Mane Aromatic Flavors are: Spearmint, E209123; Cinnamon, E0303392; Russian Tea, E0303386; Lemon, E127382; and Menthol, E127384. Such representative capsules have diameters of about 3.5 mm and about 4 mm.

The capsule outer shell or surface 260 is preferably constructed of somewhat rigid solid material that has a tendency not to leak, melt, crack, or otherwise lose its integrity between the time that it is manufactured and the time it is selectively ruptured by a smoker. Preferably, the capsule outer surface or wall 260 is a continuous sealed one-piece member in order to reduce the likelihood of leakage of the capsule payload. The preferred capsule outer surface 260 is brittle enough to readily rupture when squeezed by a smoker, but not so brittle that it breaks prematurely during manufacturing, packaging, shipping and use of the cigarette containing such a capsule. That is, the pressure required to rupture the capsule within the filter element is preferably low enough to be easily performed using the fingers of the smoker, but not so low as to result in accidental rupture of the cigarette during manufacturing, packaging, shipping, and smoking. Furthermore, the capsule outer surface preferably is constructed of material that does not adversely react with or otherwise undesirably affect the components of the payload, the cigarette tobacco, components of the filter element, or the mainstream smoke produced by the cigarette.

The capsule payload 264 can have a form that can vary; and typically, the payload has the form of a liquid, a gel, or a solid (e.g., a crystalline material or a dry powder). The payload 264 can incorporate components that aid in flavoring or scenting mainstream cigarette smoke. Alternatively, the payload may be a breath freshening agent for the smoker, a deodorizing agent for the cigarette butt, a moistening or cooling agent for the cigarette smoke, or a composition capable of otherwise altering the nature or character of the cigarette.

The payload 264 most preferably has a liquid form. Such a payload can incorporate an aromatic material intended to be drawn to the smoker independent of the presence of mainstream smoke, or material can become entrained within mainstream smoke during draw by the smoker. Preferred liquid payloads have the ability to seep or wick throughout the filter material of the filter element (and in certain circumstances, into the tobacco rod), and hence be available to mix with the smoke drawn to the smoker.

In the preferred embodiment, the capsule 220 possesses an outer surface 260 composed of gelatin and an internal payload incorporating an agent capable of altering the nature or character of mainstream smoke passing through the filter element. Typically, the outer shell 260 consists primarily of gelatin, frequently is comprised at least about 80 weight percent gelatin, and preferably consists essentially of gelatin. Outer shells consisting of essentially pure gelatin are particularly preferred. The gelatin material is preferably of a food grade, and derived from bovine, picine or porcine stock. A wide variety of gelatins may be used, and the selection of a gelatin for the capsule outer surface is considered a matter of design choice to those of ordinary skill in the art. See, Kirk-Othmer, *Encyclopedia of Chemical Technology*, ($4^{th}$ Ed.) 12, 406-416 (1994), which is incorporated herein by reference. The type of gelatin used for constructing the outer shell of the capsule provides that capsule with the capability of being exposed to triacetin (a common plasticizer used in cigarette filter manufacture) or 1,2 propylene glycol (a common tobacco casing component) for relatively long periods of time without experiencing undesirable interaction (e.g., dissolution of the gelatin therein). Because the gelatins used in the preferred embodiments may dissolve in water over extended periods of time, it is desirable to employ virtually anhydrous payloads (or payloads possessing very low amounts of water) with capsules having gelatin outer coatings. The capsules can be colored brown, or some other dark color, for assisting in detection purposes during automated manufacturing processes.

In the preferred embodiment, the payload is a mixture of a flavoring and a diluting agent or carrier. The preferred diluting agent is a triglyceride, such as a medium chain triglyceride, and more particularly a food grade mixture of medium chain triglycerides. See, for example, Radzuan et al., *Porim Bulletin,* 39, 33-38 (1999). Flavorings of the payload may be natural or synthetic, and the character of these flavors can be described, without limitation, as fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. See also, Leffingwill et al., *Tobacco Flavoring for Smoking Products*, R.J. Reynolds Tobacco Company (1972). Flavorings also can include components that are considered moistening, cooling or smoothening agents, such as eucalyptus. These flavors may be provided neat (i.e., alone) or in a composite (e.g., spearmint and menthol, or orange and cinnamon). Composite flavors may be combined in a single capsule as a mixture, or as components of multiple capsules positioned within the filter element.

The amount of flavoring and diluting agent within the capsule may vary. The relative amounts of flavoring and diluting agent selected, as well as the overall amount of the mixture of the two may be varied, for example, to provide different sensory experiences for the smoker. In some instances, the diluting agent may be eliminated altogether, and the entire payload can be composed of flavoring agent. Alternatively, the payload can be almost entirely comprised of diluting agent, and only contain a very small amount of relatively potent flavoring agent. In the preferred embodiment using a capsule of approximately 3.5 mm in diameter, the weight of the liquid payload (e.g., flavoring agent and diluting agent) is preferably in the range of about 15 mg to about 25 mg, and more preferably in the range of about 20 mg to about 22 mg. The preferred composition of the mixture of flavoring and diluting agent is in the range of about 5 percent to about 25 percent flavoring, and more preferably in the range of about 10 to about 15 percent flavoring, by weight based on the total weight of the payload, with the balance being diluting agent.

The weight of the capsule wall compared to the weight of the payload may vary. Preferably, the capsule wall is in the range of about 5 percent to about 50 percent, and more preferably in the range of about 10 to about 30 percent, of the total weight of the capsule. For a representative preferred capsule of approximately 3.5 mm in diameter, the capsule wall weighs about 2 mg to about 4 mg, and the payload weighs about 16 to about 21 mg. The payload volume typically can be about 50 percent to about 90 percent of the total volume of the capsule (i.e., including the wall and the payload), preferably about 70 percent to about 90 percent of the total capsule volume, and more preferably about 80 percent to about 90 percent of the total capsule volume.

The force required to rupture the preferred capsules before they are inserted into the filter element may be determined using a suitable force determining device, such as the Shimpo Model No. FGV10X manufactured by Shimpo Instruments, a division of the Nidec Group. When measured using a suitable device, such as the Shimpo device, the capsules preferably have individual crush strengths in the range of approximately 750 to 5000, more preferably in the range of approximately 1000 to 2500, and still more preferably in the range of approximately 1500 to 2000 (units provided by the Shimpo device are reported in grams).

Other capsules and capsule components that can be employed in carrying out certain aspects of the present invention are of the type set forth in U.S. Pat. Nos. 3,685,521 to Dock; 3,916,914 to Brooks et al., and 4,889,144 to Tateno et al.; U.S. Pat. Appl. No. 2003/0098033 to MacAdam et al.; and PCT WO 03/009711 to Kim; which are incorporated herein by reference.

Figure 6:
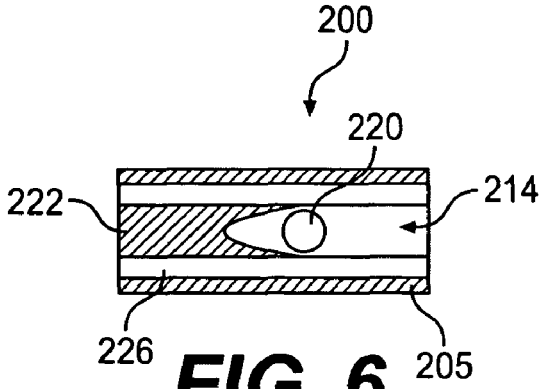
FIG. 6 is a cross-sectional view of the filter element of the cigarette shown in FIG. 2.

Referring to FIG. 6, a representative filter element 200 is shown. The filter element allows for the passage of air and smoke therethrough. The filter element possesses a cavity 214. Within the cavity 214 is located a capsule 220. The cross-sectional area of the cavity preferably is larger than the maximum cross-sectional area of the capsule 220. The cavity 214 extends longitudinally into the filter element, and the degree to which the cavity extends into the filter can vary. Typically, the cavity may extend about 10 mm to about 20 mm, and preferably about 12 mm to about 16 mm, into the filter element. The cavity 214 extends through one end of the filter element, and hence provides an opening in order to provide insertion of the capsule into the cavity. The shape of the cavity 214 is defined by a longitudinally extending inner filter portion 222, and that inner filter portion 222 is circumscribed by an outer filter material 226. An exemplary filter element can possess a cavity 214 having a generally circularly shaped cross section of about 4 mm in diameter positioned within an inner portion 222 of filter material having a maximum diameter of about 5.5 mm to about 6 mm, which is in turn positioned within and circumscribed by an outer portion 226 of filter material such that the maximum diameter of the filter element is about 7.5 mm to about 8 mm. Plug wrap 205 circumscribes outer filter portion 226, and provides the longitudinal surface of the filter element 200.

Figure 7:
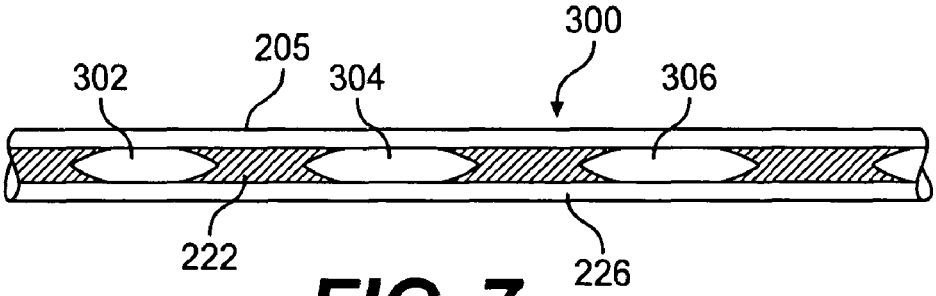
FIG. 7 is a cross-sectional view of a portion of a continuous filter rod suitable for use in the manufacture of cigarette filters.

With reference to FIG. 7, a portion of a continuous filter rod 300 is shown. Such a filter rod possesses inner filter material 222 surrounded by outer filter material 226, and plug wrap 205 circumscribes the outer filter material. A series of cavities 302, 304, 306 are spaced within that rod 300. Such a rod can be cut into segments (known as filter rods), and those filter rods can be cut into segments to make filter elements. Representative filter rods generally of this type are of the general type employed by R.J. Reynolds Tobacco Company for the production of certain styles of "Vantage" brand cigarettes. Such types of filter rods are available from Filtrona, Greensboro, N.C.

Figure 8:
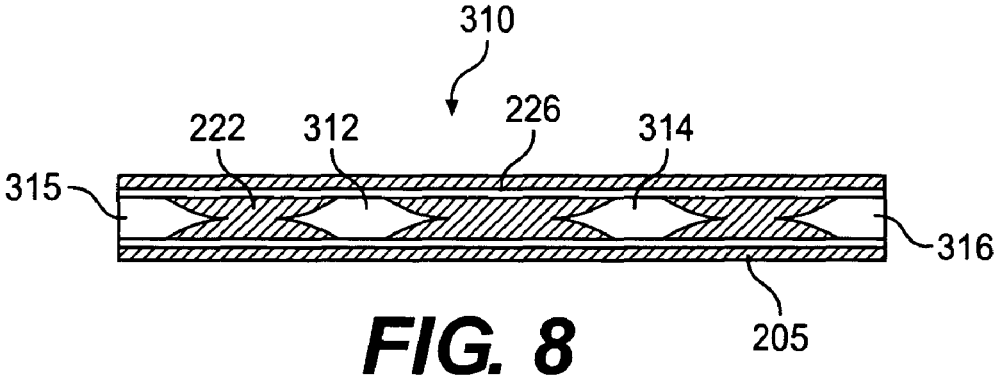
FIG. 8 is a cross-sectional view of a six-up filter rod suitable for manufacture of cigarette filters.

Referring to FIG. 8, there is shown a filter rod 310 of the type that is cut from a continuous filter rod of the type described previously with reference to FIG. 7. The filter rod 310 has a so-called six-up configuration. The filter rod 310 possesses inner filter material 222, outer filter material 226, and an outer layer of plug wrap 205. The six-up filter rod is cut through its center of enclosed cavities 312 and 314 (i.e., transverse to its longitudinal axis) so as to provide three two-up filter rod segments. The six-up rod 310 possesses open cavities 315, 316 extending from each end.

Figure 9:
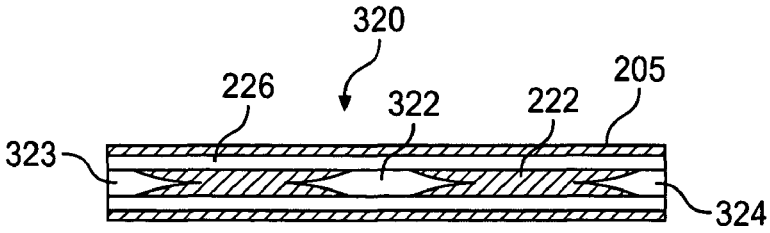
FIG. 9 is a cross-sectional view of a four-up filter rod suitable for manufacture of cigarette filters.

Referring to FIG. 9, there is shown a filter rod 320 of the type that is cut from a continuous filter rod of the type described previously with reference to FIG. 7. The filter rod 320 has a so-called four-up configuration. The filter rod 320 possesses inner filter material 222, outer filter material 226, and an outer layer of plug wrap 205. The four-up filter rod is cut through the center of its center cavity 322 (i.e., transverse to its longitudinal axis) so as to provide a pair of two-up filter rod segments. The four-up rod 320 possesses open cavities 323, 324 extending from each end.

Figure 10:
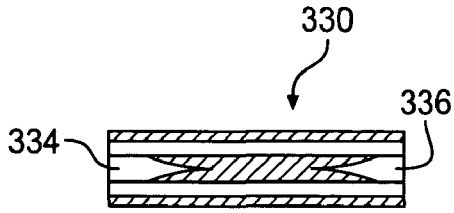
FIG. 10 is a cross-sectional view of a two-up configuration of cavity filter element suitable for manufacturing cigarettes.

Referring to FIG. 10, there is shown a two-up filter rod 330. The two-up filter rod segment 330 provides two filter elements, each having a cavity 334, 336, joined together in an end-to-end relationship such that the open ends of the two cavities 334, 336 face outward from each end of that rod.

Figure 11:
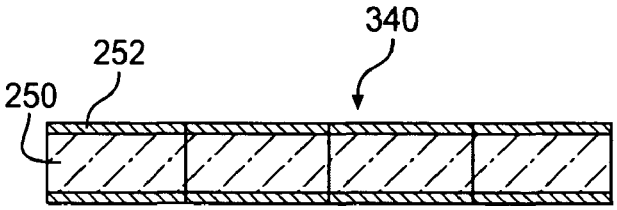
FIG. 11 is a cross-sectional view of a four-up configuration of solid filter segments suitable for the manufacture of cigarette filters.

Referring to FIG. 11, there is shown a conventional four-up filter rod 340. Such a filter rod 340 possesses filter material 250 within circumscribing plug wrap 252. As shown, such a filter rod can be cut into four cylindrical rods. A preferred four-up filter rod has a length of about 80 mm, and four cylindrical rods (each of 20 mm length) can be provided from that rod. A similar preferred six-up filter rod (not shown) has a length of about 120 mm, and six cylindrical rods (each of 20 mm length) can be provided from that rod.

Figure 12:
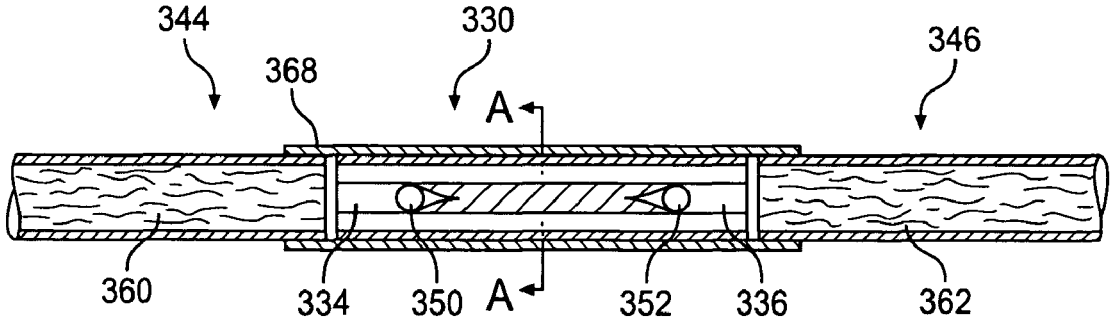
FIG. 12 is a cross-sectional view of a two-up filtered cigarette.

Referring to FIG. 12, one method of manufacturing two cigarettes 344, 346 involves providing a two-up filter rod 330 having open cavities 334, 336 at each end, and inserting capsules 350, 352 into each of the respective cavities located at each end of the filter rod. Tobacco rods 360, 362 are axially aligned at each respective end of the two-up filter rod 330 such that the ends exposing the cavities 334, 336 of the filter rod abut the ends of each respective tobacco rod 360, 362. Next, the tobacco rods 360, 362 are attached to the two-up filter rod 330 using tipping material 368 that circumscribes the outer periphery of the filter rod and adjacent regions of the tobacco rods. Thereafter, the two-up filter rod 330 is cut in half along cut line A-A to produce two individual filtered cigarettes, with each cigarette possessing a breakable capsule in its filter. The cigarettes so produced have the general format and configuration described previously with reference to FIG. 2.

Figure 13:
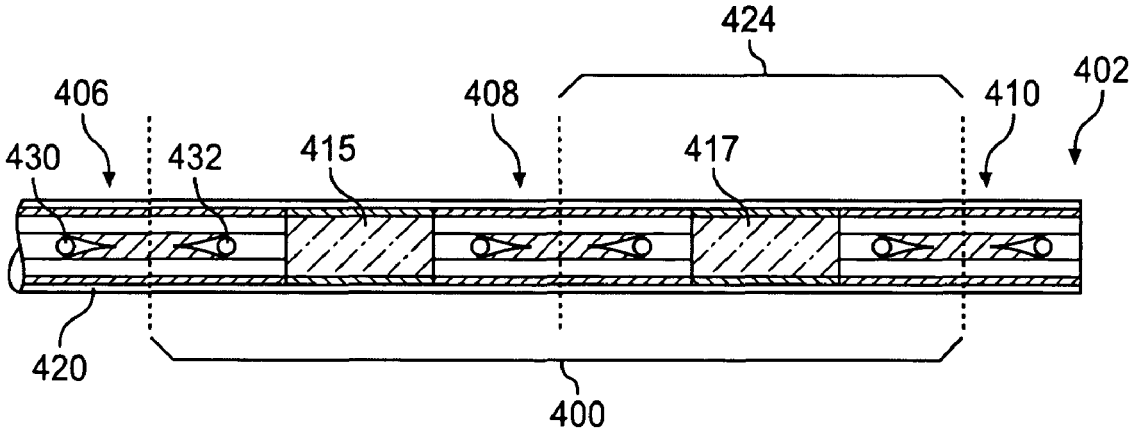
FIG. 13 is a cross-sectional view of a portion of a continuous rod composed of a series of segmented filter components.

Referring to FIG. 13, a four-up filter rod 400 is provided from a continuous rod 402. The continuous rod is provided by placing two-up cavity-containing filter rods 406, 408, 410 containing capsules 430, 432, etc., and filter segments 415, 417 in alternating end-to-end relationship; and connecting those segments together using circumscribing plug wrap 420. The plug wrap material 420 can be a paper-type material commonly used for the manufacture of cigarette filter elements, and can be that type of plug wrap material that is considered to be non-porous or porous. Next, the so-called "plug tube combined" continuous rod 402 is subdivided at desired locations to produce filter rods or rod segments of the desired length and format, such as two-up combined filter rods 424 or four-up combined filter rods 400.

Figure 14:
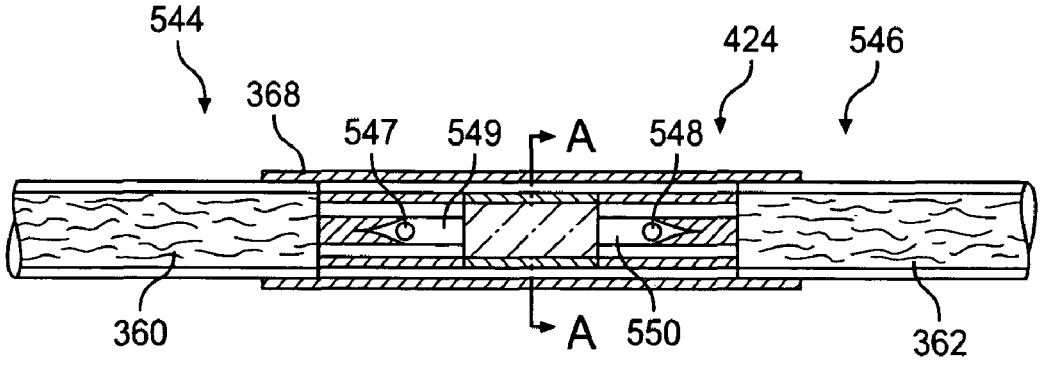
FIG. 14 is a cross-sectional view of a two-up filtered cigarette.

Referring to FIG. 14, one method of manufacturing two cigarettes 544, 546 involves providing a two-up combined filter rod 424 of the type provided with reference to FIG. 13. Capsules 547, 548 are disposed in each cavity 549, 550 located in each end of the two-up combined filter rod 424. Tobacco rods 360, 362 are axially aligned at each respective end of the two-up combined filter rod 424 such that the ends of the filter rod abut the ends of each respective tobacco rod 360, 362. Next, the tobacco rods 360, 362 are attached to the two-up combined filter rod 424 using tipping material 368 that circumscribes outer periphery of the filter rod and adjacent regions of the tobacco rods. Thereafter, the two-up combined filter rod 424 is cut in half along cut line A-A to produce two individual filtered cigarettes 544, 546, with each cigarette possessing a breakable capsule 547, 548 in its filter. The cigarettes so produced have the general format and configuration described previously with reference to FIG. 3.

Figure 15:
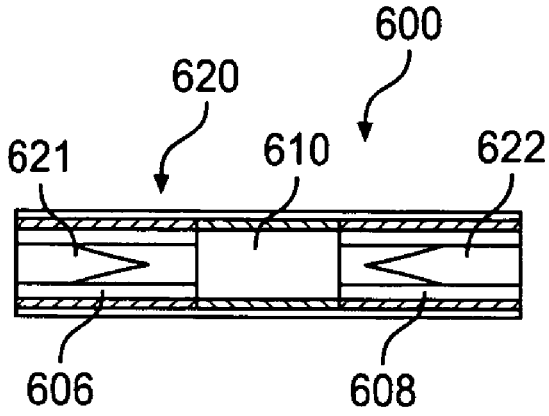
FIG. 15 is a cross-sectional view of a two-up configuration of cavity filter element suitable for manufacturing cigarettes.

Referring to FIG. 15, a two-up filter rod 600 is provided by placing cavity-containing filters 606, 608, and a filter segment 610 in an end-to-end relationship; and connecting those segments together using circumscribing plug wrap 620. The plug wrap material 620 can be a paper-type material commonly used for the manufacture of cigarette filter elements, and can be that type of plug wrap material that is considered to be non-porous or porous. The two-up rod 600 has cavities 621, 622 of the cavity-containing filters 606, 608 at each end, and the filter segment 610 is positioned between the cavity-containing filters 606, 608.

Figure 16:
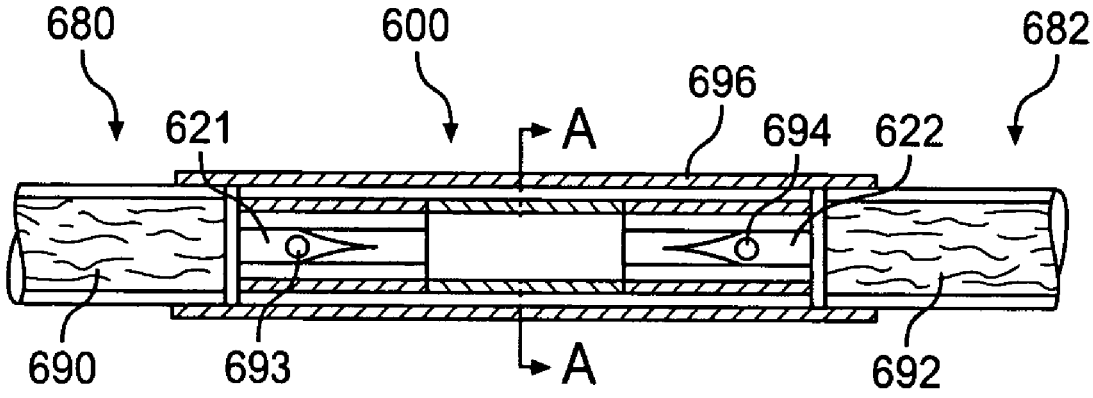
FIG. 16 is a cross-sectional view of a two-up filtered cigarette.

Referring to FIG. 16, one less preferred method of manufacturing two cigarettes 680, 682 involves providing a two-up filter rod 600 of the type provided with reference to FIG. 15. Tobacco rods 690, 692 are axially aligned with each end of the two-up filter rod 600 such that the cavity ends of the filter rod abut each tobacco rod. At least one capsule 693, 694 is inserted into each cavity 621, 622 of the filter rod 600. Next, the tobacco rods 690, 692 are attached to the filter rod 600 using tipping material 696. Thereafter, the filter rod 600 is cut in half along cut line A-A to produce two filtered cigarettes 680, 682, each possessing a breakable capsule 693, 694 in its filter element. The cigarettes so produced have the general format and configuration described previously with reference to FIG. 4.

The production of filter rods, filter rod segments and filter elements, and the manufacture of cigarettes from those filter rods, filter rod segments and filter elements, can be carried out using the types of equipment that has been employed to provide cigarette filters, multi-segment cigarette filters and filtered cigarettes. The multi-segment cigarette filter rods can be manufactured using a cigarette filter rod making device available under the brand name Mulfi from Hauni-Werke Korber & Co. KG. Six-up rods, four-up filter rods and two-up rods that are conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. Nos. 3,308,600 to Erdmann et al.; 4,281,670 to Heitmann et al.; 4,280,187 to Reuland et al.; and 6,229,115 to Vos et al.

EXPERIMENTAL EXAMPLE

The following example is provided to illustrate embodiments of the present invention, and should not be considered to limit the scope of the invention or the claims appended hereto.

Example 1

Round capsules are available from Mane Aromatic Flavors in Nice, France. The outer shell of each capsule is composed of gelatin. The capsule payload includes a natural spearmint flavor and diluting agent mixture. The spearmint flavor comprises a combination of peppermint and spearmint extracts, which are essential oils derived from various mint species that typically are isolated using steam distillation types of techniques. The diluting agent for the peppermint and spearmint mixture is a food grade mixture of medium chain triglycerides.

Two types of capsules are produced. One type of capsule has a diameter of about 3.5 mm, and the other type has a diameter of about 4 mm. The weight of a typical 3.5 mm diameter capsule is about 21 mg; the payload of that capsule weighing about 18.8 mg, and the outer gelatin portion of the capsule weighing about 2.2 mg. The weight of a typical 4 mm diameter capsule is about 37.8 mg; the payload of that capsule weighing about 34 mg, and the outer gelatin portion of the capsule weighing about 3.8 mg. The payload of a typical 3.5 mm diameter capsule is comprised of about 4.7 mg spearmint flavor. The payload of a typical 4 mm diameter capsule is comprised of about 17 mg spearmint flavor. The preferred payload is virtually absent of water.

Cigarettes of the general type shown in FIG. 2 are provided. Cigarette filters incorporating breakable capsules are provided. Each filter element possesses one filter cavity, and one breakable capsule is loaded into each filter cavity. A representative filter is generally of the type provided from filter rods obtained from Filtrona, Greensboro, N.C., and incorporated into cigarettes sold in the United States under the brand name "Vantage" by R.J. Reynolds Tobacco Company. Representative types of filters for the cigarettes that are provided may be provided from filter rods obtained from Filtrona, Greensboro, N.C. under the designation GN 30630 AA. The filters are cut into a two-up configuration, a breakable capsule is manually placed into the opening of the cavity at one end of each filter segment, the breakable capsules are seated manually in the desired location with light pressure applied from a coffee stirrer stick, and the filters are attached to tobacco rods using tipping paper. That is, each tobacco rod and each filter element are aligned in an abutting, end-to-end relationship and secured together using a non-air permeable tipping paper. The tipping paper is adhesively secured to the filter element and the adjacent portion of the tobacco rod. The filters are aligned with the tobacco rods so that the cavity is proximal to the tobacco rod. As such, two-up cigarettes are provided; and those two-up cigarettes are cut in half to provide filtered cigarettes having capsules positioned in their filter elements.

The cut tobacco filler employed in providing the tobacco rods of representative cigarettes has the form of strands cut at about 32 cuts per inch. The representative American blend portion of the final blend contains about 17 percent burley tobacco, about 34 percent flue-cured tobacco, about 21 percent reconstituted tobacco material, and about 16 percent Oriental tobacco. The American blend has about 7 percent of an aqueous casing of glycerin and flavors applied thereto prior to cutting into filler form. About 5 percent expanded, composed of about 65 percent flue-cured and about 35 about burley tobacco, then is added to the cut tobacco American blend prior to prepare the final cut filler. The blend is equilibrated to final moisture of about 12.8 percent prior to cigarette manufacture.

The tobacco blend is used to prepare cigarettes having lengths of about 84 mm and circumferences of about 25 mm. The tobacco rod lengths are about 57 mm and filter element lengths are about 27 mm. The tobacco rod includes a charge of tobacco cut filler weighing about 0.65 g contained in a circumscribing cigarette paper wrap of the type that has been available as Reference No. 854 cigarette paper from Ecusta Corp. The tipping material circumscribes the length of the filter element at about 3 mm of the length of the tobacco rod.

Cigarettes so described can be manufactured using a Pilot Cigarette Maker from Hauni-Werke Korber & Co. KG. A ring of laser perforations is provided around the periphery of the cigarette about 13 mm from the extreme mouth end thereof. The perforations penetrate through the tipping paper and plug wrap, and can be provided using a Laboratory Laser Perforator from Hauni-Werke Korber & Co. KG. The cigarettes are air diluted to about 29 percent air dilution.

The moisture level within the cigarette, and the normal ambient conditions under which the cigarettes are stored and used, do not provide sufficient moisture or exposure to water to cause destruction of the capsules within those cigarettes. That is, the amount of moisture is not sufficient to cause dissolution of gelatin, and hence deformation and destruction of the capsule. As such, the capsule maintains the ability to retain its integrity within the cigarette under normal storage, handling and use until the capsule is purposefully broken by the smoker.

Some of the cigarettes are lit and smoked without breaking the capsules contained in their filter elements. Those cigarettes provide good tobacco smoke flavor, and do not possess sensory attributes associated with spearmint flavor. Some of the cigarettes are lit and smoked, and the capsules contained in their filter elements are broken prior to being lit or after being lit. That is, the smoker squeezes the filter element of a cigarette with his/her fingers, and the capsule is ruptured. Those cigarettes provide good tobacco smoke flavor, and possess sensory attributes associated with spearmint flavor.

Some of the cigarettes containing 3.5 mm diameter capsules in their filter elements are lit, and mainstream smoke from the cigarettes is collected, sampled and analyzed under two test conditions. In one case, the capsules are allowed to remain intact throughout the smoking experience, and in the other case, capsules are broken immediately prior to the first puff. In either case, the cigarettes are smoked under FTC smoking conditions. The overall smoke chemistries of the cigarettes smoked under those two types of conditions are quite similar. Spearmint flavor is observed to transfer into the mainstream smoke cigarette possessing the broken capsule. A representative cigarette possessing the unbroken capsule yields about 11.1 mg FTC "tar," about 0.89 mg FTC nicotine, and about 12 mg FTC carbon monoxide. A representative cigarette possessing the unbroken capsule yields about 12.3 mg FTC "tar," about 0.95 mg FTC nicotine, and about 12.8 mg FTC carbon monoxide.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A cigarette comprising:

a tobacco rod;

a filter element having an outer cylindrical shape connected to the tobacco rod, said filter element having an end proximal to the tobacco rod and an end distal from the tobacco rod;

a cavity having walls defined by said filter element, and extending from the proximal end of the filter element, wherein the cavity possesses a generally conical shape at a first end and a generally cylindrical shape at a second end proximal to the tobacco rod; and at least one breakable capsule affixed in the cavity by friction between the capsule and the walls of the cavity, said capsule comprising an outer shell comprising gelatin and an internal payload in the form of an anhydrous liquid or gel comprising a flavoring agent and a diluting agent, the diluting agent comprising a triglyceride, wherein said filter element incorporates cellulose acetate treated in a manner that results in the filter element being sufficiently flexible to be squeezed to break said capsule while also being sufficiently resilient to return to a substantially cylindrical shape and maintain said cavity after being squeezed.

2. The cigarette of claim 1 wherein the cellulose acetate incorporated in the filter element is treated by impregnation with triacetin plasticizer.

3. The cigarette of claim 2 wherein the cellulose acetate incorporated in the filter element is treated by steam bonding.

4. The cigarette of claim 1 wherein said cavity includes a first region for receipt of the at least one breakable capsule and a second region for receipt of capsule contents following rupture of the capsule.

5. The cigarette of claim 1 wherein the cavity possesses an opening that is disposed in the end of the filter element proximal to the tobacco rod.

6. The cigarette of claim 1 wherein the filter element comprises:

an outer element of filter material; and an inner element of filter material, wherein said filter element inner element is crimped along an axial direction into a generally cross-shaped form.

7. The cigarette of claim 1 wherein the breakable capsule contains a component capable of altering the overall composition of mainstream smoke generated by the cigarette.

8. The cigarette of claim 1 wherein the cavity possesses a generally circular cross-sectional shape and a diameter of about 4 mm, and the capsule is generally spherical in shape and has a diameter of about 3.5 mm.

9. The cigarette of claim 1 wherein the cavity possesses a longitudinal axis dimension of approximately half of the length of the filter element.

10. The cigarette of claim 6 wherein the inner element of the filter element comprises steam bonded cellulose acetate impregnated with triacetin plasticizer.

11. The cigarette of claim 2 wherein the filter element comprises:

an outer element of cellulose acetate filter material; and an inner element of steam bonded cellulose acetate filter material.

12. The cigarette of claim 11 wherein the outer element of filter material is generally permeable to the passage of drawn mainstream smoke; and the inner element includes a crimped terminus.

13. The cigarette of claim 1 wherein the flavoring agent is a breath freshening agent.

14. The cigarette of claim 1 wherein treatment of the filter element results in the cavity being tacky on an interior surface.

15. A cigarette comprising:

a tobacco rod;

a filter element connected to the tobacco rod, said filter element having an end proximal to the tobacco rod and an end distal from the tobacco rod;

a cavity having walls defined by said filter element, and extending into the filter element from the distal end of the filter element, wherein the cavity possesses a generally conical shape at a first end and a generally cylindrical shape at a second end distal from the tobacco rod;

at least one breakable capsule affixed in the cavity by friction between the capsule and the walls of the cavity, said capsule comprising an outer shell comprising gelatin and an internal payload in the form of an anhydrous liquid or gel comprising about 5 to about 25 weight percent of a flavoring agent and the balance being a diluting agent; and a filter segment located at the end of the filter element distal from the tobacco rod, wherein said filter element incorporates cellulose acetate treated in a manner that results in the filter element being sufficiently flexible to be squeezed to break said capsule while also being sufficiently resilient to return to a substantially cylindrical shape and maintain said cavity after being squeezed.

16. The cigarette of claim 15 wherein the cellulose acetate incorporated in the filter element is treated by impregnation with triacetin plasticizer.

17. The cigarette of claim 16 wherein the cellulose acetate incorporated in the filter element is treated by steam bonding.

18. The cigarette of claim 15 wherein said cavity includes a first region for receipt of the at least one breakable capsule and a second region for receipt of capsule contents following rupture of the capsule.

19. The cigarette of claim 15 wherein the flavoring agent comprises an essential oil.

20. The cigarette of claim 15 wherein the filter element comprises:

an outer element of filter material; and an inner element of filter material, wherein said filter element inner element is crimped along an axial direction into a generally cross-shaped form.

21. The cigarette of claim 20 wherein the inner element of the filter element comprises steam bonded cellulose acetate impregnated with triacetin plasticizer.

22. The cigarette of claim 16 wherein the filter element comprises:

an outer element of cellulose acetate filter material; and an inner element of steam bonded cellulose acetate filter material.

23. The cigarette of claim 22 wherein the outer element of filter material is generally permeable to the passage of drawn mainstream smoke; and the inner element includes a crimped terminus.

24. The cigarette of claim 15 wherein the flavoring agent is a breath freshening agent.

25. The cigarette of claim 15 wherein treatment of the filter element results in the cavity being tacky on an interior surface.

26. A cigarette comprising:

a tobacco rod;

a filter element having an outer cylindrical shape connected to the tobacco rod, said filter element having an end proximal to the tobacco rod and an end distal from the tobacco rod, the filter element comprising a segment comprising an inner portion of filter tow material defining a cavity and an outer portion of filter tow material surrounding the inner portion, wherein the cavity possesses a generally conical shape at a first end and a generally cylindrical shape at a second end, and wherein the inner portion is crimped at the first end; and at least one breakable capsule affixed in the cavity by friction between the capsule and the inner portion of filter tow material, the capsule having an outer shell and an internal payload, the internal payload being in the form of an anhydrous liquid or gel comprising a flavoring agent and a diluting agent, wherein said segment of the filter element is sufficiently flexible to be squeezed to break said capsule while also being sufficiently resilient such that said segment returns to a substantially cylindrical outer shape and said cavity returns to its original defined shape after being squeezed, and wherein the force required to break the capsule is in the range of 1000 to 2500 g.

27. The cigarette of claim 26 wherein the outer portion of filter tow material is permeable to mainstream smoke and at least one of the outer portion and the inner portion is absorbent to liquids.

28. The cigarette of claim 26 wherein an interior surface of the inner portion of the segment is roughened or tacky in order to hold the breakable capsule in a fixed position.

29. The cigarette of claim 28 wherein the interior surface of the inner portion of the segment is coated with a plasticizer in order to render the surface tacky.

30. The cigarette of claim 26 wherein the breakable capsule is held in a fixed position by wedging the breakable capsule against an inclined surface of the conical portion of the cavity.

31. The cigarette of claim 26 wherein the second end of the cavity is open, and the open end faces the tobacco rod.

32. The cigarette of claim 26 wherein the second end of the cavity is open, and the open end faces the end of the filter segment distal from the tobacco rod.

33. The cigarette of claim 32 further comprising a second segment of filter material tow at the end of the filter segment distal from the tobacco rod, the second segment of filter material tow facing the open end of the cavity.

34. The cigarette of claim 26 wherein the inner portion of the segment comprises steam-bonded and plasticized cellulose acetate tow and the outer portion of the segment comprises plasticized cellulose acetate tow.

* * * * *